US011059703B2

(12) United States Patent
Lindberg

(10) Patent No.: US 11,059,703 B2
(45) Date of Patent: Jul. 13, 2021

(54) CRANE TROLLEY

(71) Applicant: KONECRANES GLOBAL CORPORATION, Hyvinkää (FI)

(72) Inventor: Teppo Lindberg, Nuppulinna (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 226 days.

(21) Appl. No.: 16/088,703

(22) PCT Filed: Mar. 29, 2017

(86) PCT No.: PCT/FI2017/050215
§ 371 (c)(1),
(2) Date: Sep. 26, 2018

(87) PCT Pub. No.: WO2017/168048
PCT Pub. Date: Oct. 5, 2017

(65) Prior Publication Data

US 2020/0231414 A1 Jul. 23, 2020

(30) Foreign Application Priority Data

Mar. 29, 2016 (FI) ..... 20165261

(51) Int. Cl.
*B66C 11/06* (2006.01)
*B66C 9/02* (2006.01)
(Continued)

(52) U.S. Cl.
CPC ..... *B66C 11/06* (2013.01); *B66C 9/02* (2013.01); *B66D 3/08* (2013.01); *B66C 9/04* (2013.01)

(58) Field of Classification Search
CPC ..... B66C 11/00; B66C 11/02; B66C 11/04; B66C 11/06; B66C 9/02; B66C 9/04; B66D 3/04; B66D 3/06; B66D 3/08
See application file for complete search history.

(56) References Cited

U.S. PATENT DOCUMENTS 3,179,376 A * 4/1965 Botten ..... B66D 3/06 254/401
5,074,423 A * 12/1991 Smith ..... B66D 3/16 212/337
(Continued)

FOREIGN PATENT DOCUMENTS

CN 203079554 U 7/2013
CN 203474335 U 3/2014
(Continued)

OTHER PUBLICATIONS

Chinese Office Action and Search Report for Chinese Application No. 201780020326.2, dated Sep. 2, 2019, with English translation.
(Continued)

*Primary Examiner* — Michael R Mansen
*Assistant Examiner* — Juan J Campos, Jr.
(74) *Attorney, Agent, or Firm* — Birch, Stewart, Kolasch & Birch, LLP

(57) ABSTRACT

A trolley of a crane is arranged to move along a main support structure of the crane. The trolley includes a support frame structure; bearing wheels fastened to the support frame structure and by means of which the trolley is arranged to move along the main support structure; a hoisting mechanism that has a rope drum for a hoisting rope; a rope pulley arrangement through which the hoisting rope may be guided from the rope drum to a fixed fastening point on the trolley; and a hoisting member in cooperation with the hoisting rope for hoisting a load. The rope drum is supported to the support frame structure of the trolley so that the axle of the rope drum is parallel to the main support structure. The rope pulley arrangement is located, in the axial direction of the rope drum, at least partly outside one rope drum end which is on the side of said fastening point. The support frame structure is divided into two separate frame parts, whereby the first frame part supports the rope pulley arrangement and
(Continued)

the rope drum end on the side thereof, and whereby the second frame part supports the opposite end of the rope drum.

11 Claims, 6 Drawing Sheets

(51) Int. Cl.
*B66D 3/08* (2006.01)
*B66C 9/04* (2006.01)

(56) References Cited

U.S. PATENT DOCUMENTS

| | | | | |
|---|---|---|---|---|
| 5,992,730 | A * | 11/1999 | McGuire | B23K 31/02 105/163.1 |
| 6,578,825 | B1 * | 6/2003 | Brandt | B66D 3/06 24/265 R |
| 7,234,400 | B2 | 6/2007 | Winter et al. | |
| 2002/0170872 | A1 * | 11/2002 | Kiviniitty | B66C 9/14 212/328 |
| 2005/0092201 | A1 * | 5/2005 | Winter | B66C 11/06 104/96 |
| 2017/0022032 | A1 | 1/2017 | Lindberg et al. | |

FOREIGN PATENT DOCUMENTS

| | | | |
|---|---|---|---|
| CN | 203903801 | U | 10/2014 |
| CN | 204125035 | U | 1/2015 |
| DE | 3032824 | A1 | 4/1982 |
| FI | 20145071 | | 7/2015 |
| KR | 10-0846209 | B1 | 7/2006 |
| KR | 10-0649728 | B1 | 11/2006 |
| SU | 1689330 | A1 | 11/1991 |
| WO | WO 99/36222 | A1 | 7/1999 |
| WO | WO 2015/110706 | A1 | 7/2015 |

OTHER PUBLICATIONS

Canadian Office Action for Canadian Application No. 3, 017,815, dated Sep. 30, 2019.

Catena Inspection & Engineering Services Ltd., "VLRP/VLRG Swivel Truck Trolley Hoists," URL:http://catenais.co.uk/wp-content/uploads/2015/01/HCB-VLRP-VLRG-Swivel-Truck-Trolley-Hoists.pdf Jan. 26, 2015, 1 page.

Korean Office Action, dated Nov. 21, 2019, for Korean Application No. 10-2016-7029980, along with an English translation.

International Search Report, issued in PCT/FI2017/050215, dated Jun. 14, 2017.

Written Opinion of the International Searching Authority, issued in PCT/FI2017/050215, dated Jun. 14, 2017.

* cited by examiner

CRANE TROLLEY

BACKGROUND OF THE INVENTION

The invention relates to a trolley of a crane, arranged to move along a main support structure of the crane, whereby the trolley comprises a frame structure; bearing wheels which are fastened to the frame structure and by means of which the trolley is arranged to move along said main support structure; a hoisting mechanism that has a rope drum for a hoisting rope, a rope pulley arrangement which has upper and lower rope pulley arrangements and through which the hoisting rope may be guided from the rope drum to a fixed fastening point on the trolley, and a hoisting member in cooperation with the hoisting rope for hoisting a load; whereby the rope drum is supported to the support frame structure of the trolley so that the axle of the rope drum is parallel to the main support structure; whereby the rope pulley arrangement is located, in the axial direction of the rope drum, at least partly outside the rope drum end which is on the side of said fastening point.

In prior art there are problems on the distribution of loads on a trolley, caused by the hoisting, whereby the trolley structure is under a heavy local strain, in particular torsional stresses of various kinds. Without major alternation work, the current structures are not suitable for different rope drum lengths or rope pulley arrangements of different widths, whereby the dimension of the upper rope drum arrangement in the axial direction of the rope drum varies. In many of the modern trolleys, the rope drum is usually positioned in the trolley structure or within the frame so that its length may not be changed in a simple manner.

SUMMARY OF THE INVENTION

An object of the invention is to improve the trolley referred to in the beginning so as to enable the aforementioned drawbacks to be solved. This object is reached by the solution according to the invention, which is characterised in that the support frame structure is divided into two separate frame parts, that is, a first frame part and a second frame part, whereby the first frame part supports the rope pulley arrangement and the rope drum end on the side thereof, and whereby the second frame part supports the opposite end of the rope drum.

Preferred embodiments of the invention are disclosed in the dependent claims.

The invention is specifically based on the fact that when the rope pulley arrangement is arranged in accordance with the invention partly or preferably entirely outside the end of a rope drum, the support frame structure is at the same time divided into two parts, one of which receives the stress caused in particular by the load being hoisted, and the other the load caused by the "free" end of the rope drum. This structure at the same time makes it possible to construct trolleys comprising upper rope pulley arrangements of different sizes and rope drums of different lengths by using the same frame components.

When most of the structure supporting a load has thus been separated from the hoisting mechanism, the structure supporting a load may be standardised independent of the rope drum length/hoisting height choice.

In particular, when the rope pulley arrangement is located, in the axial direction of the rope drum, entirely in front of the rope drum and outside the aforementioned end, the bends in the rope pulley arrangement, causing wear in the hoisting rope, may be avoided.

In the solution according to the invention, the structure supporting the trolley is mainly strained by tensile stress whereby a bending torque load is for the largest part avoided.

LIST OF FIGURES

The invention will now be described in more detail by means of a few preferred exemplary embodiments, with reference to the attached drawings, in which FIG. 1 is a simplified perspective view of the hoisting mechanism of the inventive trolley;

DETAILED DESCRIPTION OF THE INVENTION

Figure 1:
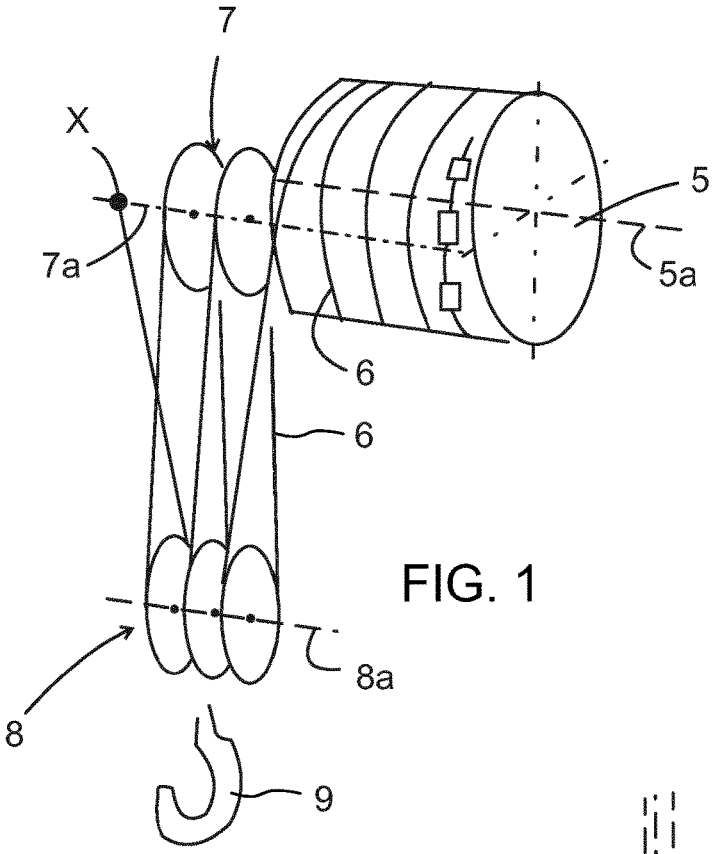
Figure 2:
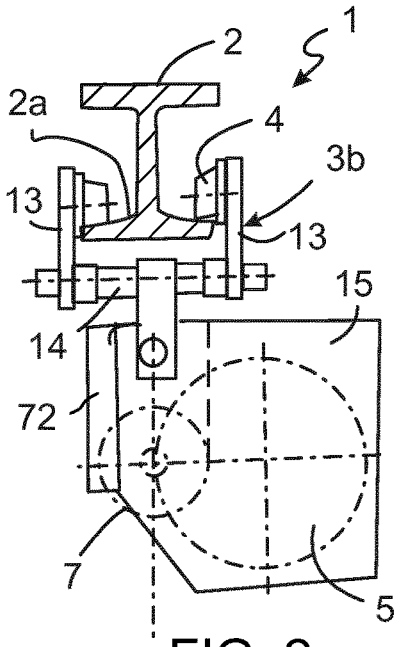
FIG. 2 is a perspective view of an inventive trolley seen from the direction of the main support.
Figure 3:
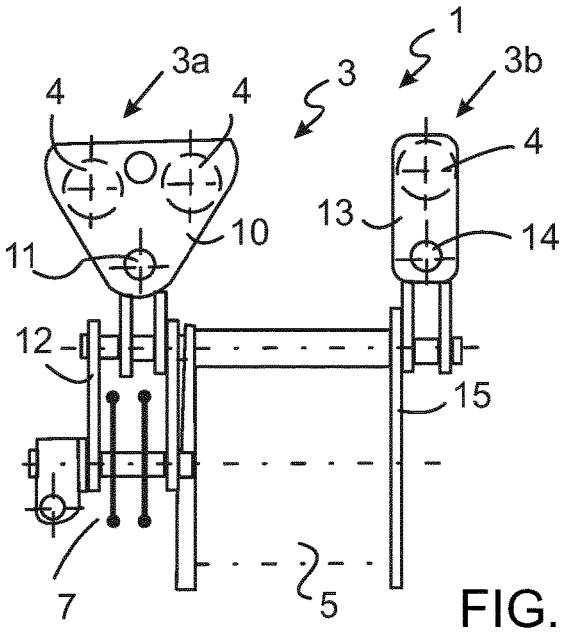
FIG. 3 is a side view of the trolley according to FIG. 2.

Referring at first to FIGS. 1 to 3, a trolley 1 according to the invention is seen, arranged to move along a main support structure 2 of a crane. The main support 2 here typically comprises a rail whereby the trolley 1 is supported on the lower flange 2*a* of this rail.

The trolley 1 has a support frame structure 3 and bearing wheels 4 which are fastened to it and by means of which the trolley 1 is arranged to move along said main support structure 2. Some of these bearing wheels 4 may be used to move the trolley 1. An actuator (a moving mechanism of the trolley) for driving the bearing wheels 4 is not shown.

Figure 12:
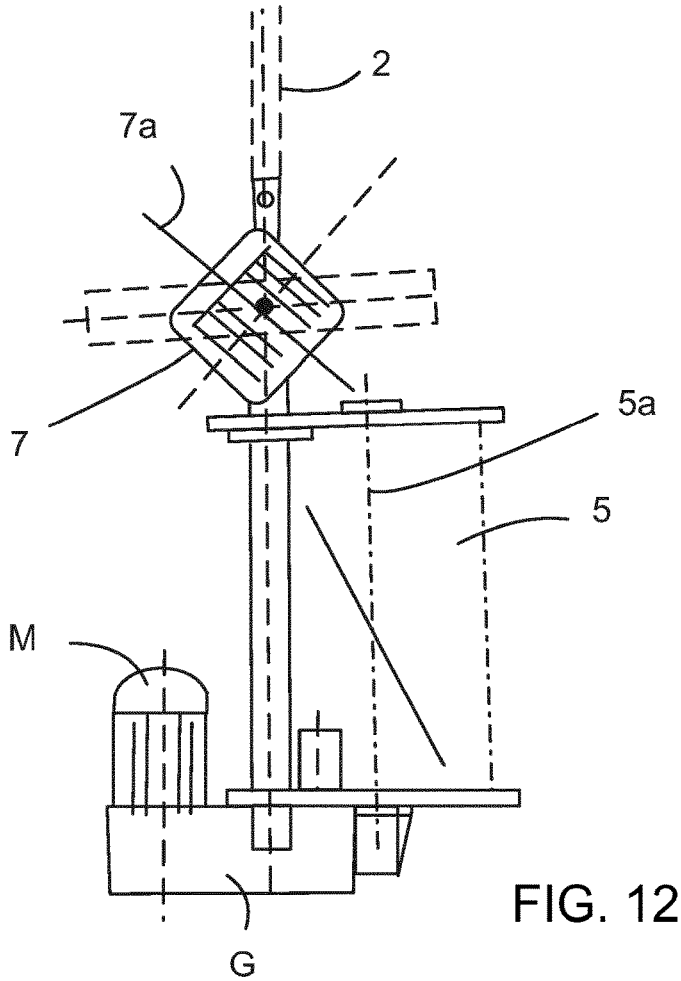
FIG. 12 shows an implementation of the upper rope pulley arrangement.

To the trolley 1, a hoisting mechanism is arranged that has a rope drum 5 for a hoisting rope 6, and a rope pulley arrangement which has upper and lower rope pulley arrangements 7 and 8, through which the hoisting rope 6 may be guided from the rope drum 5 to a fixed fastening point X on the trolley 1. A hoisting member 9 in cooperation with the hoisting rope 6 for hoisting a load is arranged in connection with the lower rope pulley arrangement 8. The rope drum 5 is supported to the support frame structure 3 of the trolley so that the axle 5*a* of the rope drum 5 is parallel to the main support structure 2. A hoisting motor and gears required to operate the hoisting mechanism (rope drum 5) is not shown (but are shown in FIG. 12).

The trolley 1 according to the invention is characterised in that the rope pulley arrangement 7, 8 is located, in the axial direction of the rope drum 5, at least partly outside the rope drum 5 end which is on the side of said fastening point X;

and in that the support frame structure 3 is divided into two separate frame parts, that is, a first frame part 3*a* and a second frame part 3*b*, whereby the first frame part 3*a* supports the rope pulley arrangement 7, 8 and the rope drum 5 end on the side thereof, and whereby the second frame part 3*b* supports the opposite end of the rope drum 5.

As FIG. 1 additionally shows (applies to the structure shown in FIGS. 2 and 3), the axles 7*a*, 8*a* of the rope pulley arrangement 7, 8 and the axle 5*a* of the rope drum 5 are at different vertical planes and the rope pulley arrangement 7, 8 is located in the axial direction of the rope drum 5 entirely outside the rope drum 5 end in question. The distance between said vertical planes from each other may advantageously equal one half of the diameter of the rope drum 5. In addition, in this case in which the trolley 1 is one that moves under one rail 2, acting as the main support structure, the disengagement point of the hoisting rope 6 from the rope drum 5, the axles 7*a*, 8*b* of the rope pulley arrangement 7, 8, and the fastening of the hoisting rope 6 to the fixed fastening point X on the trolley 1 are advantageously at essentially the same vertical plane. This vertical plane is adapted to advantageously pass essentially in the direction of the vertical main axis of inertia of the main support 2 and at the plane it defines. In such a case, it is additionally possible to arrange the disengagement point of the hoisting rope 6 from the rope drum 5, the axle 7*a* of the upper rope pulley arrangement 7 adjacent to the rope drum 5, and the fastening of the hoisting rope 6 to the fixed fastening point X on the trolley 1 at essentially the same horizontal plane.

In the solution according to FIGS. 2 and 3, the first frame part 3*a* comprises flange parts 10 disposed on both sides of the rail 2 and to each of which two bearing wheels 4 are fastened, and a transverse connecting rod 11 connecting the lower parts of the flange parts 10, to which connecting rod the frame 12 of the upper rope pulley arrangement 7 is fastened. The second frame part 3*b* comprises flange parts 13 disposed on both sides of the rail 2, to each of which one bearing wheel 4 is fastened, and a transverse connecting rod 14 connecting the lower parts of the flange parts 13, to which connecting rod the "free" end of the frame 15 of the rope drum 5 is fastened. The frame 12 of the upper rope pulley arrangement 7 and the end facing it on the frame 15 of the rope drum 5 are advantageously fastened to each other in a detachable manner.

Figure 5:
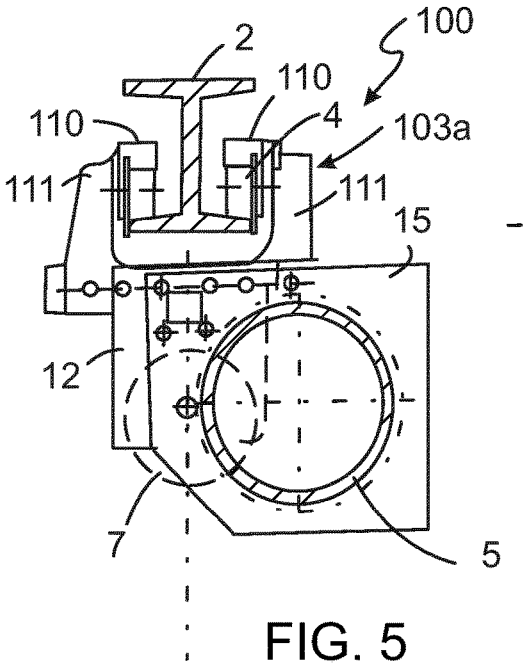
FIG. 5 is a perspective view of the trolley of FIG. 4 seen from the direction of the main support from the section 5-5 of FIG. 4.
Figure 4:
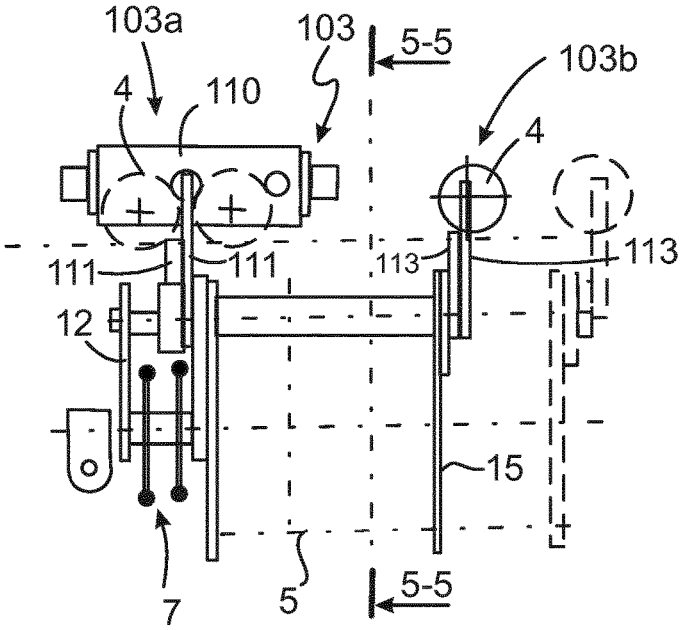
FIG. 4 is a side view of a second trolley according to the invention.

The trolley 100 according to FIGS. 4 and 5 differs from the trolley 1 of FIGS. 2 and 3 only as regards the support frame structure 103, whereby the first frame part 103*a* comprises upside down troughs 110 disposed on both sides of the rail 2, to each of which two bearing wheels 4 are fastened, and a transverse clamp structure 111 connecting the troughs 110 from their sides, to which clamp structure the frame 12 of the upper rope pulley arrangement 7 is fastened. The second frame part 3*b* comprises a clamp structure 113 extending on both sides of the rail 2, to which clamp structure one bearing wheel 4 is fastened on both sides of the rail 2. The "free" end of the frame 15 of the rope drum 5 is fastened to the lower part of this clamp structure 113. The frame 12 of the upper rope pulley arrangement 7 and the end facing it on the frame 15 of the rope drum 5 are advantageously fastened to each other in a detachable manner, as in the case of FIGS. 2 and 3. In connection with FIGS. 4 and 5, the dotted lines illustrate how easy it is to adapt the support frame structure for different lengths of the rope drum 5. The same, of course, applies to the solutions of FIGS. 2 and 3 as wells as the solutions described below.

Figure 7:
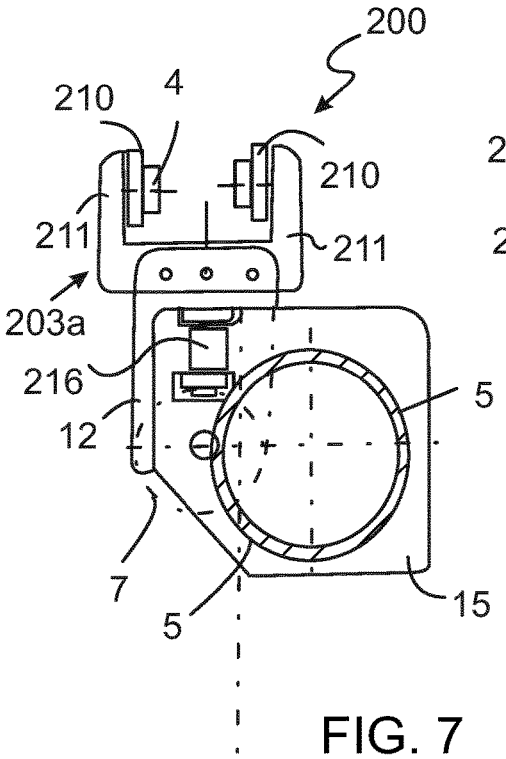
FIG. 7 is a perspective view of the trolley of FIG. 6 seen from the direction of the main support from the section 7-7 of FIG. 6.
Figure 6:
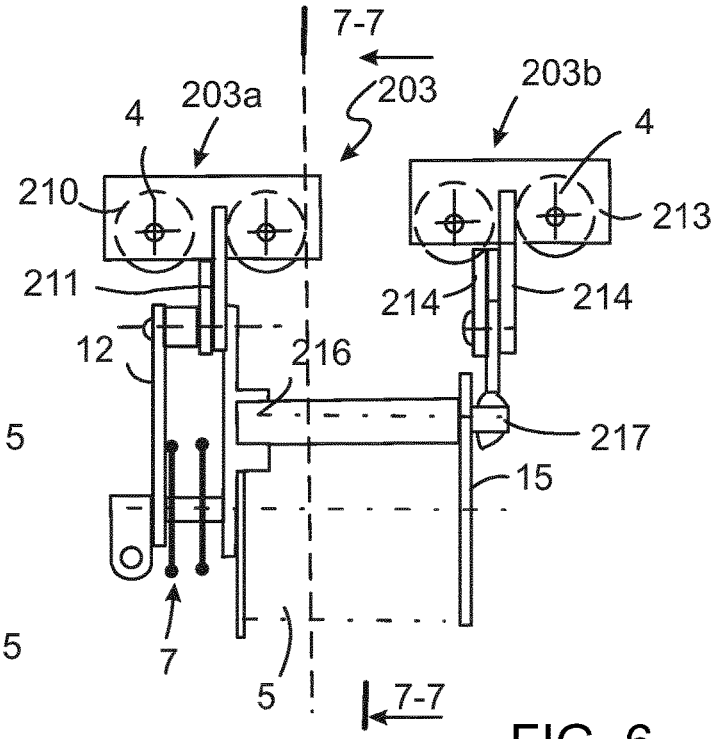
FIG. 6 is a side view of a third trolley according to the invention.
Figure 13:
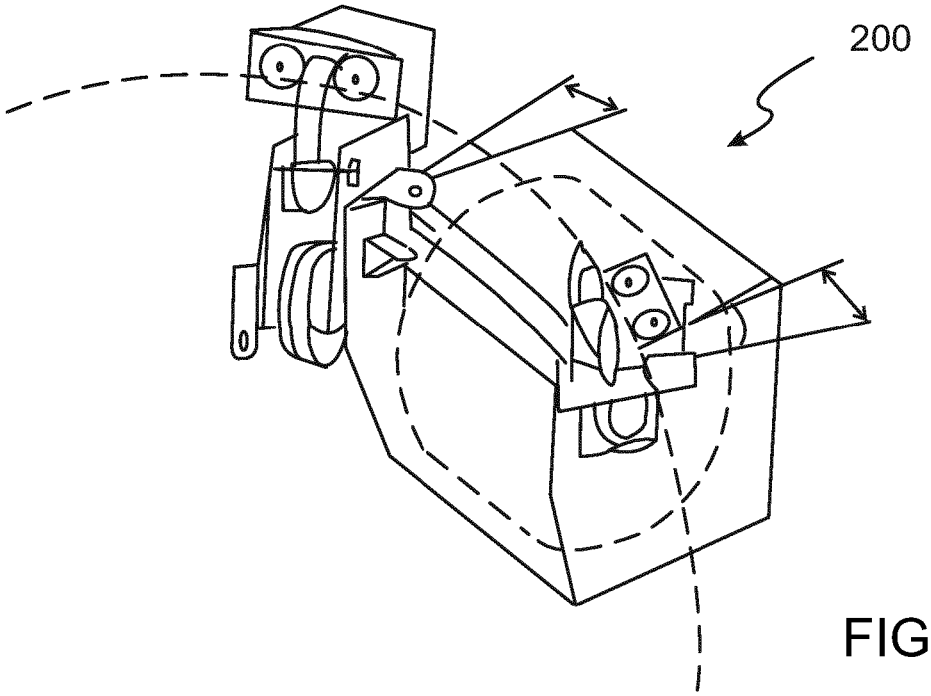
FIG. 13 shows the trolley according to the invention on a curved track.

The trolley 200 according to FIGS. 6 and 7 in the first place differs from the trolleys in the above Figures as regards the support frame structure 203, whereby the first frame part 203*a* comprises flanges 210 disposed on both sides of the rail 2, to each of which two bearing wheels 4 are fastened, and a transverse clamp structure 211 connecting the flanges 210 from their sides, to which clamp structure the frame 12 of the upper rope pulley arrangement 7 is fastened. The second frame part 203*b* corresponds to the first frame part 203*a* and comprises flanges 213 disposed on both sides of the rail 2 and to each of which two bearing wheels are fastened, and a clamp structure 214 connecting the flanges 213 from their sides. The "free" end of the frame 15 of the rope drum 5 is fastened to the lower part of this clamp structure 214. In addition, the frame 12 of the upper rope pulley arrangement 7 and the end facing it on the frame 15 of the rope drum 5 are fastened to each other with a rotating coupling 216 to allow the mutual rotation of the rope pulley arrangement 7, 8 and the rope drum 5 around a vertical axis. This structure is advantageous when the need arises to drive the trolley on a curved track, in other words, a curved main support structure (see FIG. 13). Further, a rotating coupling 217 is arranged between the second frame part 203*b* and the adjacent "free" end of the frame 15 of the rope drum 5 to allow the mutual rotation of the second frame part 203*b* and the rope drum 5 around a vertical axis. Of these two rotating couplings, the first rotating coupling 216 may be considered more important than the second rotating coupling 217.

Figure 8:
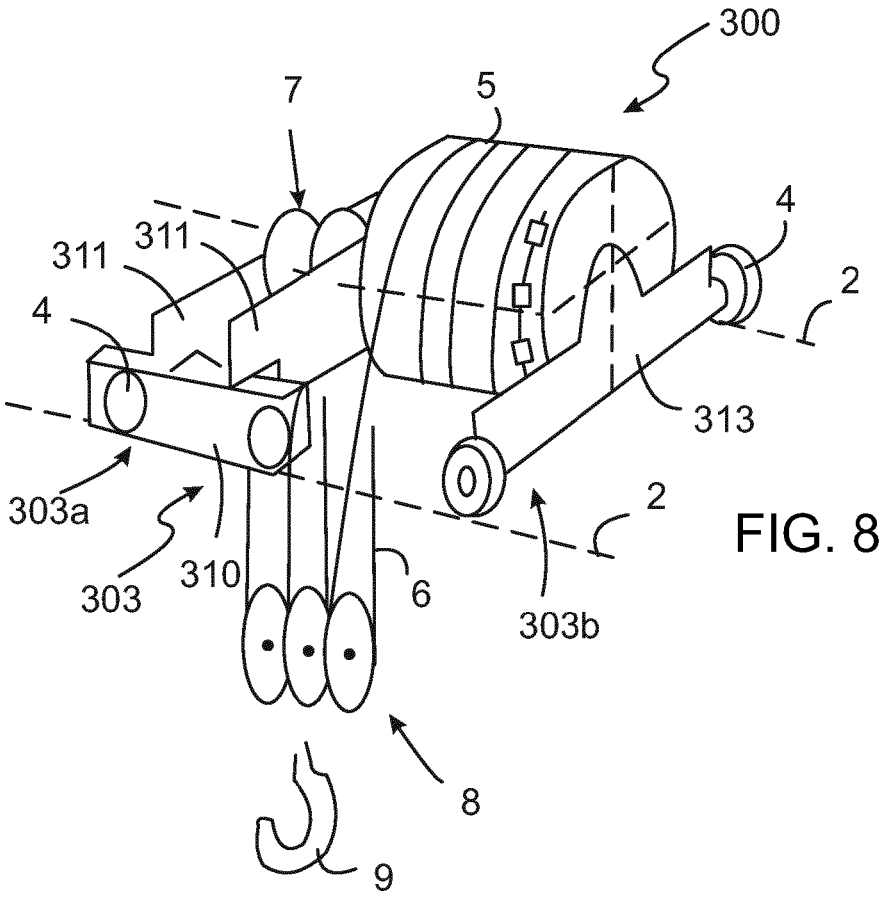
FIG. 8 is a perspective view of a fourth trolley according to the invention.
Figure 9:
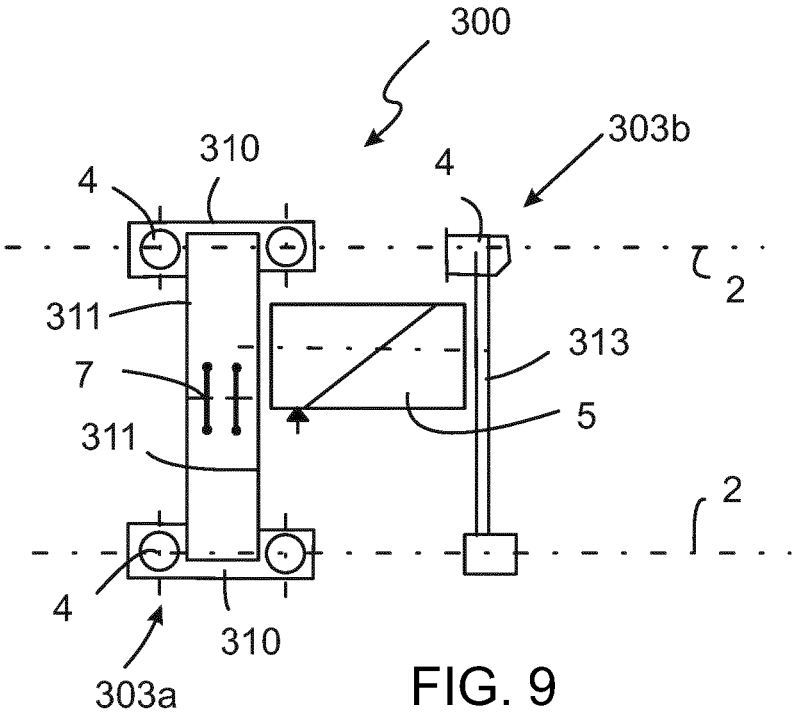
FIG. 9 is a top view of the trolley according to FIG. 8.

FIGS. 8 and 9 show a trolley 300, which moves on two main supports 2, whereby each main support 2 may be formed of a similar rail as in the case of one main support 2. This is in principle simpler than a trolley that moves under a main support 2, because the upper rope pulley arrangement 7 and the rope drum 5 may be placed directly on the support frame structure 303 without separate "intermediate frames". In this trolley 300 put forth, the first frame part 303*a* comprises, at both main supports 2, casings 310 to each of which two bearing wheels 4 are disposed and which are connected with transverse beams 311. The upper rope pulley arrangement 7 is placed between these transverse beams 311. The second frame part 303*b* comprises one transverse beam 313, on both ends of which one rail wheel 4 is disposed at any one time. The first frame part 303*a* and the rope drum 5 end facing it may be rigidly fastened to each other or with a rotating coupling around a vertical axis, like a trolley that moves under the main support 2. In this case, the location of the "power transmission line" on the same vertical plane as the disengagement point of the hoisting rope 6 from the rope drum 5, the rope pulley arrangement 7, 8 and the fixing point of the hoisting rope on the trolley 300 is not, however, as advantageous or necessary as for a trolley that moves under a main support, because the structure of the trolley 300 is load-bearing in any case.

Figure 10:
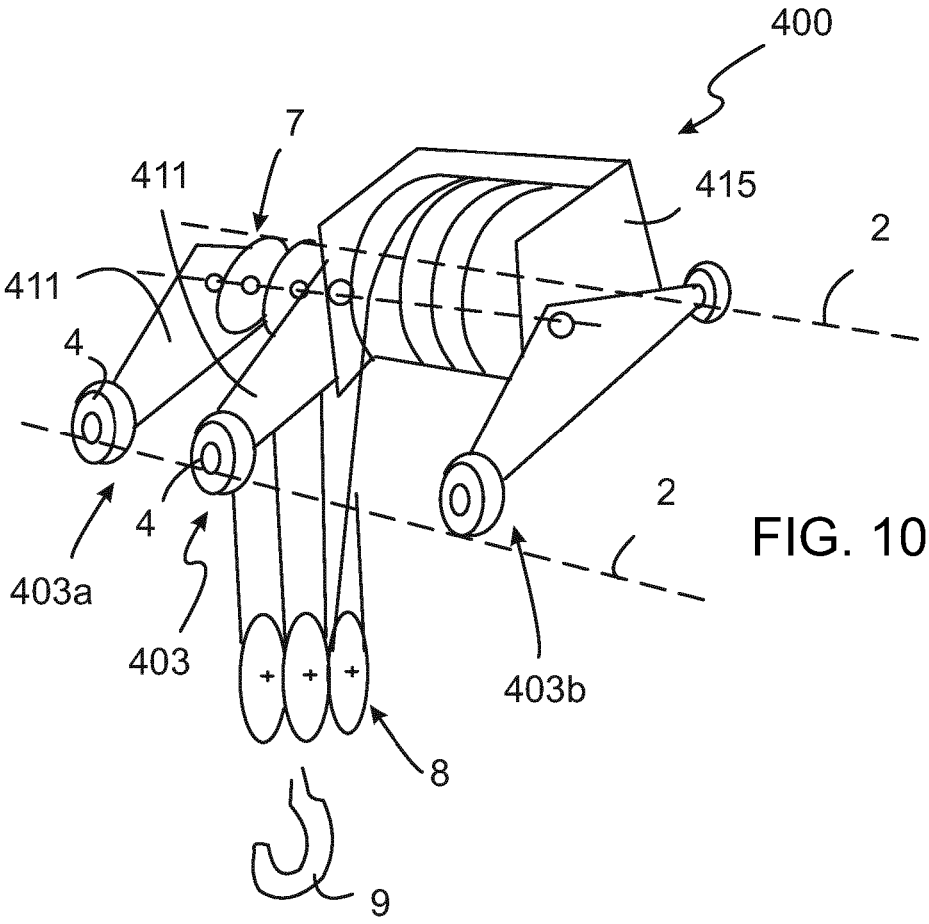
FIG. 10 is a perspective view of a fourth trolley according to the invention.
Figure 11:
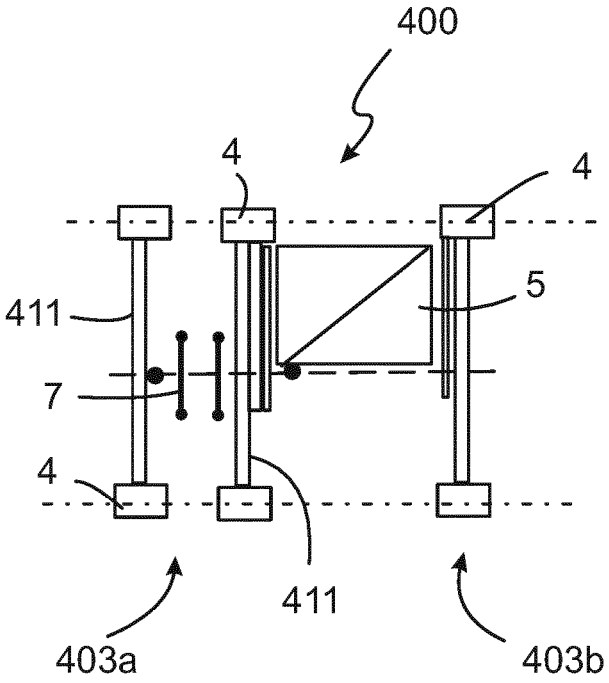
FIG. 11 is a top view of the trolley according to FIG. 10.

Likewise, FIGS. 10 and 11 show a trolley 400 that moves on two main supports 2 and differing from the structure shown in FIGS. 8 and 9 in that the first frame part 403*a* of the support frame structure 403 consists of two transverse beams 411 the ends of which at any one time always have one bearing wheel 4, so in a similar manner as in the second frame part 303*b* in FIGS. 8 and 9. Such a "slice-like" frame structures is simple to adapt on different widths of the upper rope pulley arrangement 7 as well. Here, the rope drum 5 has a dedicated protection or support frame 415 arranged for it.

FIG. 12 shows yet another solution according to the invention as regards the upper rope pulley arrangements 7, whereby this the axle 7*a* of this rope pulley arrangement 7 is slanted in relation to the vertical plane passing through the rope drum 5. Here, the motor M and gears G associated with the hoisting mechanism are also seen.

The above description of the invention is only intended to illustrate the basic idea of the invention. A person skilled in the art may thus vary its details within the scope of the attached claims.

The invention claimed is:

1. A trolley of a crane, arranged to move along a main support structure of the crane, whereby the trolley comprises:

a support frame structure;

bearing wheels fastened to the support frame structure and by means of which the trolley is arranged to move along said main support structure;

a hoisting mechanism comprising:

a rope drum for a hoisting rope;

a rope pulley arrangement which has upper and lower rope pulley arrangements, the hoisting rope is guidable from the rope drum to a fixed fastening point on the trolley through the upper and lower rope pulley arrangements; and a hoisting member in cooperation with the hoisting rope for hoisting a load, wherein the rope drum is supported to the support frame structure of the trolley so that an axle of the rope drum is parallel to the main support structure, wherein the rope pulley arrangement is located, in the axial direction of the rope drum, at least partly outside the rope drum end which is on the side of said fastening point, and wherein the support frame structure is divided into two separate frame parts, including a first frame part and a second frame part, the first frame part supports the rope pulley arrangement and a rope drum end on a side of the rope pulley arrangement, the second frame part supports an opposite end of the rope drum, and the first and second frame parts are separately supported on the main support structure without any common intermediate support.

2. The trolley as claimed in claim 1, wherein an axles of the rope pulley arrangement and the axle of the rope drum are at different vertical planes.

3. The trolley as claimed in claim 2, wherein a distance between said vertical planes from each other equals one half of a diameter of the rope drum.

4. The trolley as claimed in claim 1, wherein the rope pulley arrangement is located, in an axial direction of the rope drum, entirely outside the rope drum end which is on a side of said fastening point.

5. The trolley as claimed in claim 1, wherein axles of the upper and lower rope pulley arrangements in an immediate vicinity of the rope drum is slanted in relation to a vertical plane passing through the rope drum.

6. The trolley as claimed in claim 1, wherein between the upper rope pulley arrangement and an end of the rope drum that is adjacent to the upper rope pulley arrangement, a rotating coupling has been arranged to allow a mutual rotation of the rope pulley arrangement and the rope drum around a vertical axis.

7. The trolley as claimed in claim 1, wherein between the second frame part and an end of the rope drum that is adjacent to the second frame part, a rotating coupling has been arranged to allow a mutual rotation of the second frame part and the rope drum around a vertical axis.

8. The trolley as claimed in claim 1, wherein the trolley is one that moves under one main support, a disengagement point of the hoisting rope from the rope drum, at least axles of the upper and lower rope pulley arrangements adjacent the rope drum, and a fastening of the hoisting rope to the fixed fastening point on the trolley are at a same vertical plane.

9. The trolley as claimed in claim 8, wherein said same vertical plane is adapted to pass in the direction of a vertical main axis of inertia of the main support and at the plane the vertical main axis of inertia of the main support defines.

10. The trolley as claimed in claim 8, wherein the disengagement point of the hoisting rope from the rope drum, an axle of the upper rope pulley arrangement adjacent the rope drum, and the fastening of the hoisting rope to the fixed fastening point on the trolley are at a same horizontal plane.

11. The trolley as claimed in claim 1, wherein the trolley is one that moves on two main supports.

* * * * *